US005515762A

United States Patent [19]

Perkins et al.

[11] Patent Number: 5,515,762

[45] Date of Patent: May 14, 1996

[54] GUITAR SLIDE

[76] Inventors: Michael R. Perkins, 1975 Union Ave., NE.; Donald L. Kirven, 14790 Liberty Church Rd., both of Minerva, Ohio 44657

[21] Appl. No.: 395,086

[22] Filed: Feb. 27, 1995

[51] Int. Cl.[6] ..... G10D 3/00

[52] U.S. Cl. ..... 84/315

[58] Field of Search ..... 84/315, 316, 317, 84/318, 319

[56] References Cited

U.S. PATENT DOCUMENTS

| | | | |
|---|---|---|---|
| 1,741,285 | 12/1929 | Carpenter | 84/319 |
| 1,748,053 | 2/1930 | Blair | 84/319 |
| 3,638,525 | 2/1972 | Sciubra et al. | 84/319 |
| 3,927,595 | 12/1975 | Ferguson | 84/322 |
| 4,681,012 | 7/1987 | Stelma et al. | 84/422 |
| 5,261,307 | 11/1993 | Domanski | 84/322 |

FOREIGN PATENT DOCUMENTS 602024 8/1934 Germany .

*Primary Examiner*—Patrick J. Stanzione
*Attorney, Agent, or Firm*—Sand & Sebolt

[57] ABSTRACT

A guitar slide for permitting the user to contact a single string, or any pair of adjacent strings of a stringed instrument. The guitar slide includes a body of a length sufficient to contact any pair of adjacent strings on a stringed instrument, an inner end formed with a hole for receiving the tip of the user's finger, and an outer end formed with an arcuate end cap adapted to be positioned adjacent the tip of the user's finger. The guitar slide body is shorter than the distance between the tip of the user's finger and the first knuckle of the user's finger to assure that the finger has the same flexibility as if the user was not wearing the guitar slide, which length is sufficient to allow guitar slide 1 to contact any two adjacent strings.

15 Claims, 1 Drawing Sheet

GUITAR SLIDE

BACKGROUND OF THE INVENTION

1. Technical Field

The invention relates generally to fingering devices for stringed instruments. More particularly, the invention relates to guitar slides. Specifically, the invention relates to guitar slides which allow the user to contact a single string, or any pair of adjacent strings when playing a guitar to alter the sound produced by the contacted string or strings.

2. Background Information

The playing of musical instruments, and specifically stringed instruments have enjoyed popularity for many years as both a relaxing recreational activity as well as a means for generating income. As the purchase of recording media, and radio and television broadcasting becomes more popular, so does the playing of guitars, etc. in an effort to emulate popular musical recording artists. This popularity will likely increase as artists continue to achieve fame and fortune by exploiting their musical talents.

As individuals become increasingly interested in stringed instruments, such as guitars, the need to expand the range of sounds that are generated by the instrument also increases. The generation of unique sound not only assures that the instrument remains interesting to play, but allows the particular instrument to be utilized in a wider variety of musical formats. Additionally, an artist who is more versatile with a chosen instrument will be more marketable when pursuing a musical career.

As such, a variety of picks and fingering devices have been developed to assist guitarists, and other musicians in the generation of sound from stringed instruments. One such device is a finger shield for use when playing stringed instruments disclosed in R. S. Blair U.S. Pat. No. (1,748,053) which allows a user to depress one or more strings for assuring that only the desired string is depressed against the guitar fret.

Another device is the segmented musical pick of Domanski U.S. Pat. No. (5,261,307) which includes a pick having a number of fingering devices attached thereto. While the above devices are presumably adequate for the purpose for which they are intended, they generally provide a means for assuring that the chosen string is affirmatively depressed against the guitar fret without contacting other strings adjacent the chosen string to be depressed.

Another type of fingering device which has been developed is the guitar slide, also known as a guitar steel. The use of guitar slides is also increasing in popularity as well known musical groups increasingly incorporate the sounds created by using the guitar slide into musical recordings. A guitar slide is usually manufactured of brass, steel or glass, and is worn on one of the user's fingers on the user's left hand. The guitar slide is then brought into contact with a number of the strings of the guitar, while the user strokes the strings with the right hand. Generally, the guitar string is not depressed into contact with the guitar fret as the unique sound is created when the sound vibrates the metal or glass guitar slide. However, the user may utilize the guitar slide to depress the string into contact with the fret to achieve a more muted sound. Further, the guitar slide may be moved along the string as it vibrates to vary the string pitch by altering the effective vibrating frequency of the string while simultaneously assuring that the string vibrates through the metal or glass guitar slide, again varying the sound generated thereby.

A number of guitar slides have been developed in the prior art. One such slide is Sciurba et al. U.S. Pat. No. (3,638,525). Sciurba provides a guitar slide mounted behind the first knuckle of the user's finger. The slide is semi-circular, and allows the user to slide the guitar strings with the back of the user's finger, and pick the guitar strings with the front of the user's finger.

Another guitar slide which has been well received in the art is a hollow cylindrical tube, again manufactured of glass, steel or brass, which is worn over the entire length of one of the user's fingers whereby the user slides the exterior surface of the cylindrical tube along the guitar strings.

While the above two guitar slides are presumably adequate for the purpose for which they are intended, the above guitar slides do not provide a fingering device which allows the user to slide any pair of adjacent strings with the guitar slide. Additionally, it is difficult, for even an expert slide player, to slide a single string with the hollow cylindrical tube described above. Both Sciurba and the cylindrical guitar slide described above, cannot be utilized to slide any pair of adjacent strings on a stringed instrument. It is also extremely difficult to utilize the hollow cylindrical tube to slide alternate strings on the guitar by utilizing multiple cylindrical tubes on the user's hands. Additionally, the prior art devices do not provide the freedom of movement desired when playing a stringed instrument.

Inasmuch as the hollow cylindrical tube of the prior art must contact the string to be acted upon by the slide, and every string therebelow, the guitar is often tuned out of standard tuning such that a chosen cord, for example a G cord, is struck when the slide is positioned over the strings of the stringed instrument. While altering the tuning of the stringed instruments is presumably adequate for the purpose for which it is intended, it does not permit the user to play all major cords of the stringed instrument, and also assumes that the user will use multiple guitars, one guitar tuned to standard tuning for standard play, and a second guitar tuned to one major cord when slide play will be utilized.

Further, in an effort to further increase the flexibility of stringed instruments, guitar players often tap on, or note sound. "Tapping on" occurs when a note is sounded and a second note is struck, or "tapped on" with the right hand by hitting a note to create a harmonic with the first sounding note. Note sounding was not possible with the guitar slides of the prior art, as the guitar slide necessarily contacted the string to be acted upon, and all strings extending therebelow.

Therefore, a need exists for a guitar slide which allows a user to slide a single guitar string, or any pair of adjacent guitar strings while simultaneously assuring that every joint on the user's left hand is operable. Additionally, the need exists for a pair of guitar slides such that when worn on a pair of fingers of the user's hand, any strings, in any combination, can be contacted by the guitar slide. Still further, a need exists for a guitar slide which may be utilized with a guitar tuned to standard tuning.

SUMMARY OF THE INVENTION

Objectives of the invention include providing a fingering device which allows a user to slide one or more guitar strings.

Another objective is to provide a guitar slide which allows the user to contact any single string, or any pair of adjacent strings on a stringed instrument.

A further objective is to provide a guitar slide manufactured of brass, steel or glass.

A still further objective is to provide a pair of guitar slides, such that when the slides are used in combination, any combination of strings on a stringed instrument may be contacted by the guitar slides.

Yet another objective is to provide a guitar slide which, when worn by the user, maintains the flexibility of the user's hand as if the user is not wearing the guitar slide.

Still another objective is to provide a guitar slide which may be utilized with a guitar tuned to standard tuning, and which will permit the user to play all major cords.

These and other objectives and advantages of the invention are obtained by the improved guitar slide, the general nature of which may be stated as including an annular body having an arcuate exterior surface, an inner end and an outer end; the inner end being formed with a hole adapted for receiving a user's finger; an end cap extending over the outer end, and adapted to extend over a tip of the user's finger; and the distance between the inner and outer ends adapted to be less than the distance between the tip of the user's finger, and the first knuckle of the user's finger.

BRIEF DESCRIPTION OF THE DRAWINGS

Preferred embodiments of the invention, illustrative of the best modes in which applicant has contemplated applying the principles, are set forth in the following description and are shown in the drawings and are particularly and distinctly pointed out and set forth in the appended claims.

Similar numerals refer to similar parts throughout the drawings.

DESCRIPTION OF THE PREFERRED EMBODIMENTS

Figure 1:
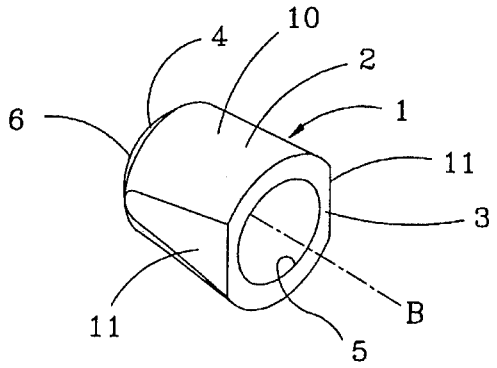
FIG. 1 is a perspective view of the guitar slide of the present invention.
Figure 2:
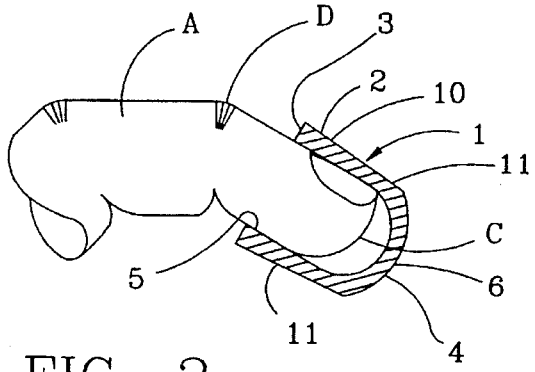
FIG. 2 is a sectional view of the guitar slide shown in FIG. 1, shown installed on a user's fingers.

The improved guitar slide of the present invention is indicated generally at 1, and is particularly shown in FIGS. 1 and 2. Guitar slide 1 includes an annular body 2, an inner end 3, and an outer end 4. Inner end 3 is formed with a hole 5 having an axial centerline B for receiving the tip C of a user's finger A as shown specifically in FIG. 2. Outer end 4 is formed with an end cap 6 extending over hole 5, and positioned adjacent tip C of the user's finger A as shown specifically in FIG. 2. End cap 6 is arcuate in configuration, and includes an apex substantially axially aligned with axial centerline B of hole 5.

Annular body 2 is formed with a frustoconical outer surface 10 such that the diameter of outer surface 10 adjacent inner end 3 is larger than the diameter of outer surface 10 adjacent outer end 4. Outer surface 10 is also formed with a pair of parallel and spaced apart flats 11, the purpose for which will be described in detail below.

Figure 5:
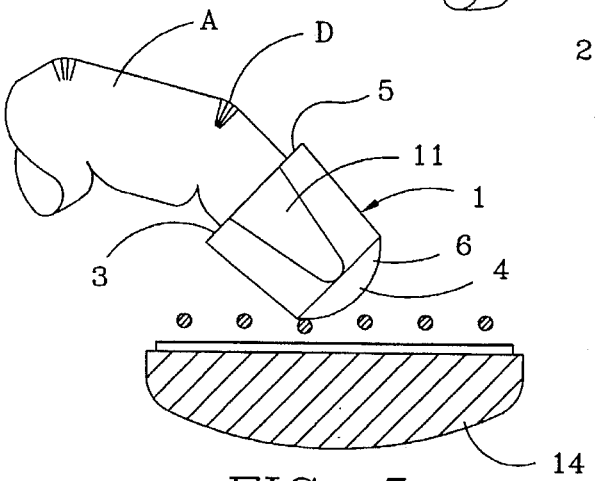
FIG. 5 is a side elevational view of the guitar slide shown in FIG. 1, installed on a user's finger, and in a third position relative to a guitar, also shown in section.

In accordance with one of the main features of the present invention, annular body 2 of guitar slide 1 is of a length sufficient to contact only two strings of a stringed instrument (FIGS. 3 and 4), with end cap 6 having a sufficient radius of curvature to assure that it may be utilized to contact a single string of a stringed instrument (FIG. 5). In further accordance with the invention, annular body 2 also has a length shorter than the distance between the tip C of the user's finger A, and the first knuckle D of the user's finger A. As such, when guitar slide 1 is worn on a user's finger A, the mobility of knuckle D is not inhibited, such that the user may flex finger A as if guitar slide 1 was not being utilized.

As is also apparent from a review of FIG. 2, hole 5 and body 2 are axially aligned to assure that the position of guitar slide 1 is closely associated with the position of the user's finger A.

Figure 3:
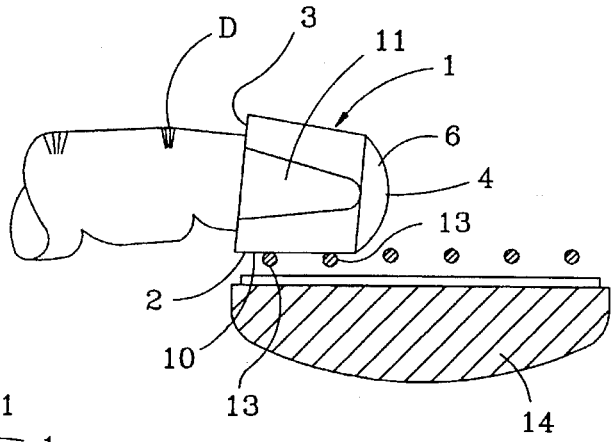
FIG. 3 is a side elevational view of the guitar slide shown in FIG. 1, installed on a user's finger, and in a first position relative to a guitar, also shown in section.
Figure 4:
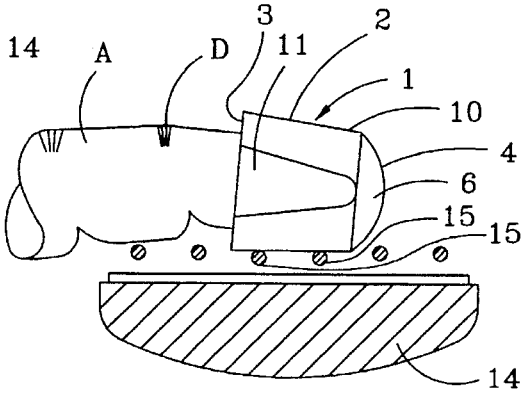
FIG. 4 is a side elevational view of the guitar slide shown in FIG. 1, installed on a user's finger, and in a second position relative to a guitar, also shown in section.

In operation, and specifically referring to FIG. 3, when knuckle D of user's finger A is straight, the frustoconical outer surface 10 of body 2 of guitar slide 1 may be utilized to contact a first pair of strings 13 of a guitar 14. Similarly referring to FIG. 4, outer surface 10 of guitar slide 1 may be utilized to contact a pair of adjacent strings 15 intermediate the six strings of guitar 14. The sliding of any pair of adjacent strings, as shown particularly in FIG. 4, is only possible because of the relatively short length of guitar slide 1. The flexibility of knuckle D of the user's finger A further assures that guitar slide 1 may be positioned over any pair of adjacent strings on guitar 14 to further increase the user's flexibility in playing guitar 14.

As should also be apparent from a review of FIGS. 2 and 5, guitar slide 1 of the present invention may be worn on the user's right hand such that when a first note is sounded, the user may tap on, or sound a second note via the guitar slide 1 positioned on the user's right hand thus creating a harmonic between the successively sounded musical notes. Additionally, inasmuch as guitar slide 1 contacts only the strings of the guitar which the user desires to contact, the guitar may remain in standard tuning while the user slides single notes, or full cords thus giving greater flexibility to the user playing the stringed instrument.

Still further, when the user flexes knuckle 12 of finger A as shown specifically in FIG. 5, arcuate end cap 6 may be utilized to depress and slide a single string of guitar 14.

The user employing guitar slide 1 when playing guitar 14 may thus slide the bottom two strings, as is possible with many guitar slides (FIG. 3), but in accordance with one of the primary elements of the invention, may also slide any pair of adjacent strings 15 of guitar 14 (FIG. 4). Additionally, guitar slide 1 may be utilized to slide a single string of guitar 14 (FIG. 5) to provide the user the greatest flexibility when playing guitar 14.

Parallel and spaced apart flats 11 are positioned on either side of guitar slide 1 and are positioned intermediate the finger housed within hole 5, and the adjacent finger. In this manner, flats 11 assure that guitar slide 1 does not hold the user's fingers apart and that there is relatively little distance between the user's fingers further enhancing the flexibility and mobility of the user's fingers relative to each other.

Figure 6:
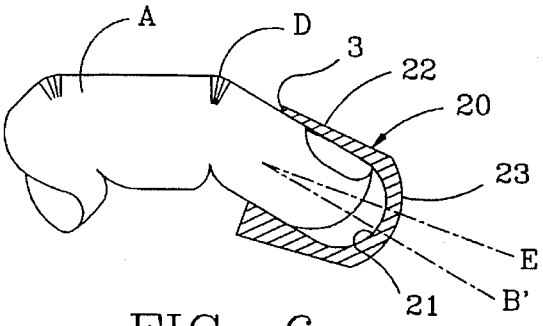
FIG. 6 is a sectional view of the guitar slide of a second embodiment of the present invention, shown installed on a user's finger.

In accordance with a second embodiment of the present invention, guitar slide 20 is shown generally in FIG. 6. Guitar slide 20 is similar to guitar slide 1 except that guitar slide 20 includes a hole 21 having an axial centerline $B^1$ and an exterior surface 22 having an axial centerline E and an end cap 23. In accordance with the second embodiment of the present invention, axial centerlines A and B are eccentrically offset relative to each other. By offsetting axial centerlines A and $B^1$, a user can easily move between the position wherein exterior surface 22 contacts any pair of strings of guitar 14, and the position where end cap 23 contacts a single string of guitar 14.

As should also be apparent from a review of FIGS. 1 and 6, multiple guitar slides may be worn on the finger's of the user's hand to allow the user to slide any combination of strings on the stringed instrument such that if a pair of guitar slides 1 or 20 are worn on the user's left hand, the user is able to slide any pair of strings on guitar 14 by contacting a single string with each guitar slide. Additionally, the user could slide as many as four strings by utilizing outer surface 10 of each guitar slide 1 to contact any pair of adjacent strings without departing from the spirit of the present invention. As such, guitar slides 1 and 20 provide increased flexibility in the generation of sound from the stringed instrument, as well as increased flexibility of the user's hand over existing prior art guitar slides.

As is apparent from a review of FIGS. 1 and 6, guitar slides 1 and 20 may be manufactured from a variety of materials, with brass, glass, steel, copper, ceramic or porcelain being utilized in the preferred embodiment.

Accordingly, the various embodiments described hereinabove, successfully overcome problems associated in the art, and create a guitar slide which may be utilized to slide any pair of adjacent strings on a stringed instrument, as well as a guitar slide which may be utilized to contact a single string of a stringed instrument and provide flexibility in the user's fingers as if the user was not wearing guitar slide 1.

Accordingly, the improved guitar slide is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved guitar slide is constructed and used, the characteristics of the construction, and the advantageous, new and useful results obtained; the new and useful structures, devices, elements, arrangements, parts and combinations, are set forth in the appended claims.

We claim:

1. A guitar slide adapted to be worn by a user comprising:

an annular body manufactured entirely of a material which is adapted to vibrate when in contact with a string of a stringed instrument having an arcuate exterior surface, an inner end and an outer end adapted to be slid over at least one string of a stringed instrument;

the inner end being formed with a hole adapted for receiving a user's finger;

an end cap extending over the outer end, and adapted to extend over a tip of the user's finger and to contact a single string of a stringed instrument; and the distance between the inner and outer ends adapted to be less than the distance between the tip of the user's finger, and the first knuckle of the user's finger.

2. A guitar slide as defined in claim 1 in which the exterior surface is substantially frustoconical in configuration adapted for contacting any pair of adjacent strings of a string instrument.

3. A guitar slide as defined in claim 1 in which the exterior surface includes at least one flat planar portion extending along the exterior surface between the inner end and the end cap adapted to be positioned intermediate the finger on which the guitar slide is worn, and an adjacent finger.

4. A guitar slide as defined in claim 1 in which the exterior surface is formed with a pair of flats, each flat adapted to be positioned intermediate the finger on which the guitar slide is worn, and an adjacent finger.

5. A guitar slide as defined in claim 1 in which the end cap is arcuate whereby the end cap is adapted to contact a single guitar string.

6. A guitar slide as defined in claim 5 in which the hole formed in the inner end is axially aligned with the exterior surface.

7. A guitar slide as defined in claim 5 in which the hole formed in the inner end is eccentrically offset relative to the exterior surface.

8. A guitar slide, in combination with a guitar of the type having a plurality of strings and a neck, said guitar slide comprising:

an annular body manufactured entirely of a material which is adapted to vibrate when in contact with a string of a stringed instrument having an arcuate exterior surface for contacting two of the plurality of guitar strings, an inner end and an outer end adapted to be slid over at least one string of a stringed instrument;

the inner end being formed with a hole adapted for receiving the user's finger;

an end cap extending over the outer end for contacting one of the plurality of guitar strings; and the distance between the inner and outer ends adapted to be less than the distance between the tip of the user's finger, and the first knuckle of the user's finger.

9. A guitar slide as defined in claim 8 in which the exterior surface is frustoconical in configuration for contacting any pair of adjacent guitar strings of the plurality of guitar strings.

10. A guitar slide as defined in claim 8 in which the exterior surface includes at least one flat portion extending along the exterior surface between the inner end and the end cap adapted to be positioned intermediate the finger on which the guitar slide is worn, and an adjacent finger.

11. A guitar slide as defined in claim 8 in which the exterior surface is formed with a pair of planar flats, each flat adapted to be positioned intermediate the finger on which the guitar slide is worn, and an adjacent finger.

12. A guitar slide as defined in claim 8 in which the hole formed in the inner end is eccentrically offset exterior surface.

13. A guitar slide as defined in claim 8 in which the hole formed in the inner end is eccentrically offset relative to the exterior surface.

14. A guitar slide adapted to be worn by a user comprising:

an annular body which is manufactured from one of a group of materials including glass, steel, brass, copper, ceramic and porcelain having an arcuate exterior surface, an inner end and an outer end;

the inner end being formed with a hole adapted for receiving a user's finger;

an arcuate end cap extending over the outer end, and adapted to extend over a tip of the user's finger and to contact a single guitar string; and the distance between the inner and outer ends adapted to be less than the distance between the tip of the user's finger, and the first knuckle of the user's finger.

15. A guitar slide, in combination with a guitar of the type having a plurality of strings and a neck, said guitar slide comprising:

an annular body manufactured from one of a group of materials including glass, steel, brass, copper, ceramic and porcelain having an arcuate exterior surface for contacting two of the plurality of guitar strings, an inner end and an outer end;

the inner end being formed with a hole adapted for receiving the user's finger;

an end cap extending over the outer end for contacting one of the plurality of guitar strings; and the distance between the inner and outer ends adapted to be less than the distance between the tip of the user's finger, and the first knuckle of the user's finger.

* * * * *